US011938365B1

(12) United States Patent
Dorsey

(10) Patent No.: US 11,938,365 B1
(45) Date of Patent: Mar. 26, 2024

(54) ELASTIC WEIGHT-SET EXERCISE DEVICE

(71) Applicant: Kevin J. Dorsey, Verona, WI (US)

(72) Inventor: Kevin J. Dorsey, Verona, WI (US)

(73) Assignee: Kevin J. Dorsey, Verona, WI (US)

( * ) Notice: Subject to any disclaimer, the term of this patent is extended or adjusted under 35 U.S.C. 154(b) by 230 days.

(21) Appl. No.: 17/507,135

(22) Filed: Oct. 21, 2021

Related U.S. Application Data

(60) Provisional application No. 63/094,616, filed on Oct. 21, 2020.

(51) Int. Cl.
*A63B 21/04* (2006.01)
*A63B 21/055* (2006.01)

(52) U.S. Cl.
CPC ..... *A63B 21/0442* (2013.01); *A63B 21/0552* (2013.01)

(58) Field of Classification Search
CPC ..... A63B 21/0442; A63B 21/0552
See application file for complete search history.

(56) References Cited

U.S. PATENT DOCUMENTS 4,685,670 A * 8/1987 Zinkin ..... A63B 21/169 482/904
5,074,551 A * 12/1991 Olschansky ..... A63B 21/151 482/130
8,348,814 B1 1/2013 Hinds et al.
8,480,549 B1 7/2013 Hinds et al.
8,968,167 B1 * 3/2015 Abelbeck ..... A63B 21/4035 482/130
9,050,497 B2 * 6/2015 Reyes ..... A63B 21/062
10,709,954 B1 * 7/2020 Stark ..... A63B 21/00065
2008/0318740 A1 * 12/2008 Ross ..... A63B 21/063 482/92
2009/0149301 A1 * 6/2009 Johnson ..... A63B 21/063 482/98
2010/0267530 A1 * 10/2010 Gerschefske ..... A63B 21/023 482/130
2012/0108401 A1 * 5/2012 Uygan ..... A63B 23/03541 482/94
2013/0017935 A1 * 1/2013 Endelman ..... A63B 21/154 482/131
2013/0210593 A1 * 8/2013 McBride ..... A63B 23/1218 482/142

(Continued)

*Primary Examiner* — Andrew S Lo
(74) *Attorney, Agent, or Firm* — Craig Fieschko; DeWitt LLP

(57) ABSTRACT

An exercise device provides elastic members which extend from an anchor to a movable carriage, such that a user can move the carriage in opposition to the resistance of the elastic members to perform exercise. The elastic members are preferably removably attached to both the anchor and the carriage so that they can be removed and replaced with elastic members having different resistances. Attachment at the carriage is preferably achieved via weight modules situated between the members and the carriage, with the elastic members being removably attached to the weight modules, and the weight modules having latches which affix to the carriage. The carriage may be actuated by a user via a pulley system which decreases the amount of carriage travel, thereby reducing the stretch in the elastic members so that they provide less variation in the effective force/weight experienced by the user.

20 Claims, 7 Drawing Sheets

(56) References Cited

U.S. PATENT DOCUMENTS

| | | | | |
|---|---|---|---|---|
| 2013/0217547 | A1 | 8/2013 | Hinds et al. | |
| 2014/0121076 | A1* | 5/2014 | Lagree | A63B 22/0089 482/123 |
| 2015/0072841 | A1* | 3/2015 | Lagree | A63B 21/0442 482/139 |
| 2015/0165259 | A1* | 6/2015 | Huppee | A63B 21/0557 482/99 |
| 2018/0169464 | A1* | 6/2018 | Janowski | A63B 21/153 |
| 2019/0308058 | A1* | 10/2019 | Endelman | A63B 21/023 |

* cited by examiner

FIG. 4a
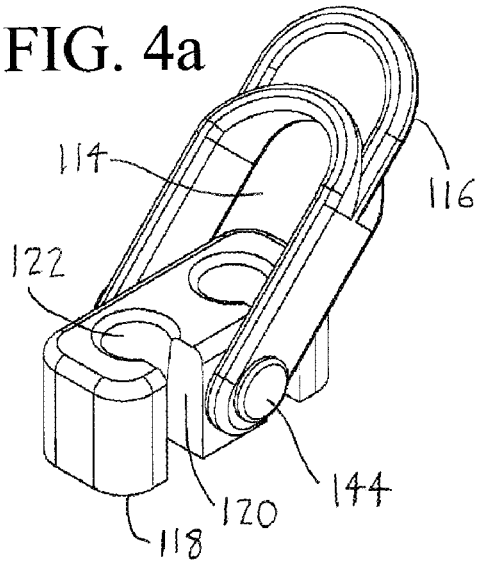
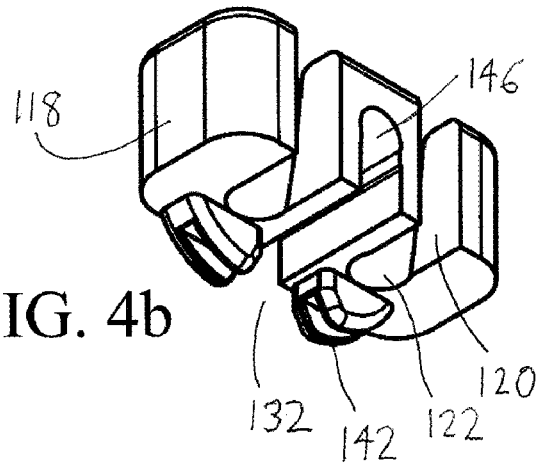
FIG. 4b
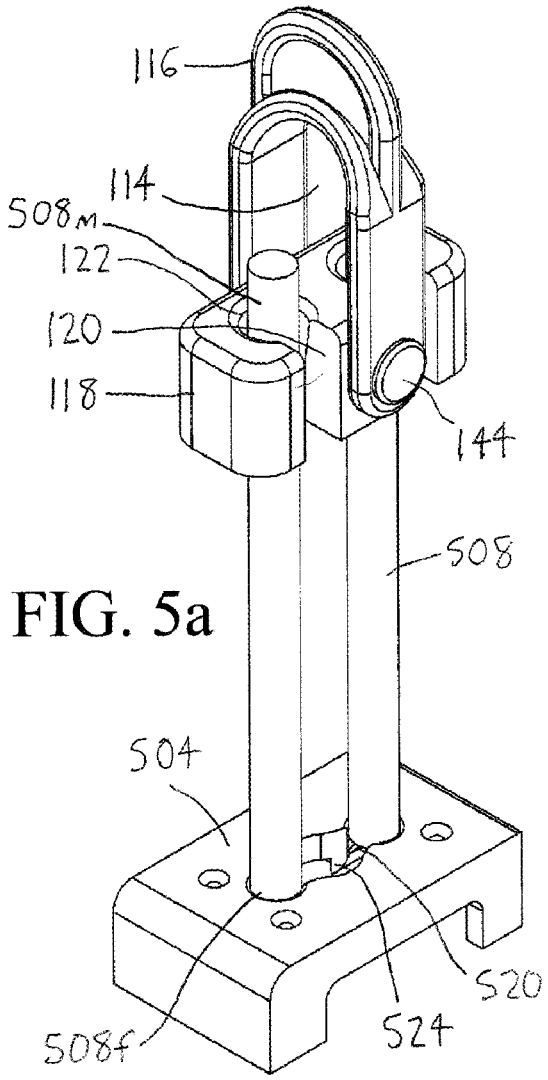
FIG. 5a
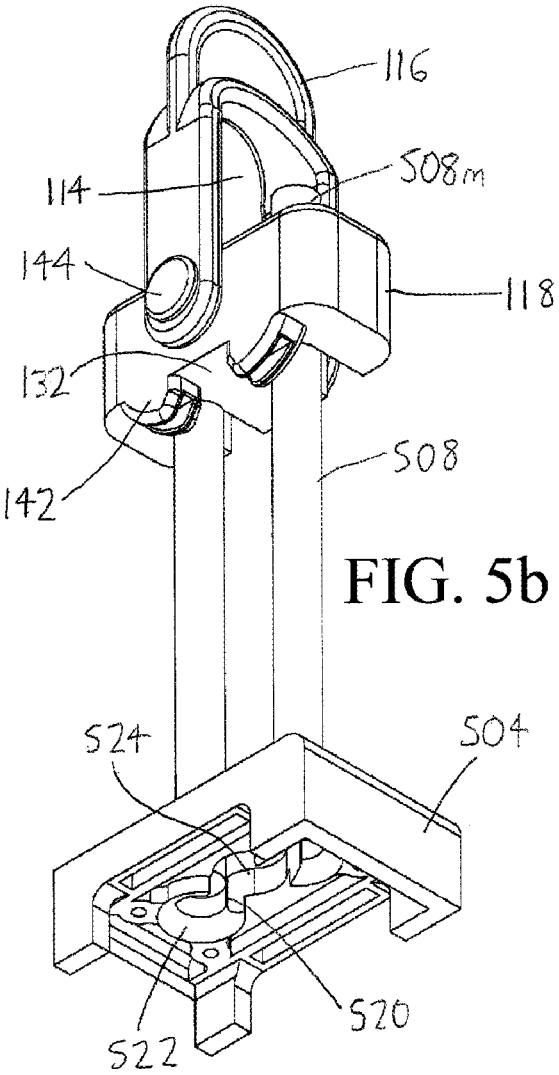
FIG. 5b

ELASTIC WEIGHT-SET EXERCISE DEVICE

FIELD OF THE INVENTION

This document concerns an invention relating generally to exercise devices for physical fitness and rehabilitation, and more specifically to exercise devices using elastic resistance.

BACKGROUND OF THE INVENTION

A variety of exercise devices use sets of weights—typically metal weights, often provided in the form of plates—wherein one or more of the weights can be operatively linked by a user to a linkage or cable, and wherein the user then acts on the linkage/cable (e.g., by pushing or pulling on an attached handle or bar) to move the linked weights, and thereby exercise. These weight-set exercise devices usefully tend to provide a wide range of effective weight (by users linking the desired number of weights/plates), often up to high weight levels (hundreds of pounds or kilos). However, these weight-set exercise devices tend to be heavy, bulky, and expensive in terms of both material and shipping/transport costs.

Other exercise devices use elongated elastic members (e.g., elastic tubes, cords, or straps), with users pushing or pulling on the members (or on bars, handles, or other grips attached to the members) so that the members serve as elastic resistances against the users' efforts, with the elastic resistance simulating weight. In some cases, these elastic members are made removable and replaceable on their grips by forming the members with enlarged ends (as by inserting plugs into the ends of elastic tubes), and then selectively affixing these member ends to the grips. This is often done by inserting the elastic member into a notch formed in the grip, and then pulling the elastic member taut until the enlarged member end engages the grip about the edges of the notch (with the enlarged member end often fitting into a pocket defined in the grip, with the notch extending into the pocket). As examples, see, e.g., U.S. Pat. Nos. 8,348,814B1 and 8,480,549B1 and the patents referenced therein (with the contents of all of these patents hereby being incorporated by reference, such that the contents of these patents effectively form a portion of the content of this document). While elastic member exercise devices tend to be far lighter and less expensive than weight-set exercise devices, a disadvantage is that it can be difficult to vary their resistance to any significant degree, as resistance is typically changed by swapping an elastic member having a particular degree of resistance with another elastic member having another degree of resistance. This limits resistance to discrete selections provided by available elastic members, and there is typically little or no ability to use combinations of elastic members to provide additional resistance selections. Additionally, swapping elastic members from an exercise device to obtain different resistances can be annoying to a user who wishes to exercise continuously (or nearly so) owing to the time needed to swap members, and owing to the decreased cardiovascular stress during such swapping (as users may wish to maintain a prolonged and consistent level of exertion). Elastic members also do not accurately simulate weight sets since the resistive force exhibited by an elastic member is typically approximated by Hooke's law, which may be expressed as force=(amount of stretch)×(member elasticity). As the elasticity of an elastic member is typically constant, the foregoing relation means that an elastic member's resistive force is dynamic, increasing with the amount of stretch. In contrast, a weight set offers a constant degree of resistive force (weight).

SUMMARY OF THE INVENTION

The invention, which is defined by the claims set forth at the end of this document, is directed to exercise devices which at least partially alleviate the aforementioned problems. The following brief summary of the invention provides a basic understanding of some of the features of preferred versions of the device, with more details being provided elsewhere in this document. To assist in the reader's understanding, the following review makes reference to the accompanying drawings (which are briefly reviewed in the "Brief Description of the Drawings" section following this Summary section of this document).

Referring to the exemplary exercise device 100 of FIGS. 1-3, the exercise device 100 includes a frame 102 having an anchor 104 situated thereon; a carriage 106 configured to translate along the frame 102 between a relaxed position (FIGS. 2*a*-2*b*) and a tensioned position (FIGS. 1 and 2*c*-2*d*) situated further from the anchor 104 than the relaxed position; and elongated elastic members 108 (here elastic tubes) which each have a fixed elastic member end 108*f* (see particularly FIGS. 2*b*-2*c*) which is fixed with respect to the frame 102 (here at the anchor 104), and a motive elastic member end 108*m* configured to selectively affix to the carriage 106 (i.e., each elastic member's motive elastic member end 108*m* may be attached to or detached from the carriage 106 by a user). Thus, a user may attach the motive elastic member end 108*ms* of one or more selected elastic members 108 to the carriage 106 (ideally when the carriage 106 is in its relaxed position and the elastic members 108 have low elastic tension), thereby providing the carriage 106 with some user-defined degree of elastic resistance when the carriage 106 is urged toward its tensioned position. The carriage 106 can then be moved by the user in opposition to the elastic resistance of the elastic members 108 to perform exercise, as by the user pulling on one or more cables 110 which actuate the carriage 106 (as exemplified by FIG. 1).

The following arrangement is preferably used to achieve affixment of the motive elastic member end(s) 108*m* to the carriage 106. Looking particularly to FIG. 3, the carriage 106 has carriage affixment members 112 thereon (here provided as male members), and each motive elastic member end 108*m* has a motive end affixment member 114 thereon (here provided as a female socket). Each motive end affixment member 114 is configured for selective fixation to one of the carriage affixment members 112, here by situating a selected male member 112 into a corresponding female socket 114. Each motive end affixment member 114 is pivotally repositionable with respect to the motive elastic member end 108*m* whereupon the motive end affixment member 114 is provided (compare FIGS. 2*b* and 2*c*), such that each motive end affixment member 114 may pivot toward and engage a corresponding carriage affixment member 112. More particularly, each motive end affixment member 114 (female socket) is defined on a pivotable latch 116, whereby each latch 116 can be pivoted with respect to its motive elastic member end 108*m* to have its female socket 114 receive a corresponding male member 112 on the carriage 106, thereby affixing its elastic member 108 to the carriage 106. In this manner, a user may affix any number of selected elastic members 108—which may have different elastic resistances—to the carriage 106 to provide the carriage 106 with a desired resistance to motion (see FIG. 1, wherein only certain selected elastic members 108 are affixed to the carriage 106).

The motive end affixment members 114 (the female sockets) are preferably provided on weight modules 118 (seen particularly in FIGS. 4*a*-4*b*), with each weight module 118 being configured to selectively affix to a respective motive elastic member end 108*m* (here by inserting a tubular elastic member 108 into a notch 120 in a weight module 118, and then fitting the enlarged end of the tube 108 into a pocket 122 at the end of the notch 120, resulting in an arrangement as seen at the top of FIG. 5*a*). Each elastic member 108 is then selectively affixable to the carriage 106 via its affixed weight module 118. The weight modules 118 beneficially provide faster and easier connection of selected elastic members 108 to the carriage 106: a user may simply latch or unlatch selected weight modules 118 (and thus their elastic members 108) to the carriage 106 (compare FIGS. 2*b* and 2*c*), rather than engaging in the more time-consuming task of connecting selected elastic members 108 directly to the carriage 106 (as might be done if the aforementioned pocket-bearing notches 120 were provided on the carriage 106).

As with the selective affixment of the motive elastic member ends 108*m* to the carriage 106 (e.g., via the weight modules 118 affixed thereto), the fixed elastic member ends 108*f* are preferably selectively affixed to the anchor 104, so that a user may readily swap out any elastic member 108 for a different elastic member 108 when desired (in particular, one having different elasticity and thus presenting different resistance to user motion). This could be done, for example, by providing the anchor 104 with the aforementioned pocket-bearing notches 120 (an arrangement which will be discussed below with reference to the alternative anchor 504 of FIGS. 5*a*-5*b*). However, in the exemplary exercise device 100 of FIGS. 1-3 (see particularly FIG. 3), each elastic member 108 extends about the anchor 104 such that the elastic member 108 has its fixed elastic member end 108*f* at the anchor 104, and two elastic member segments 108*a* and 108*b* extending therefrom, with each segment terminating in a motive elastic member end 108*m*. Each elastic member 108 can then have both of its motive elastic member ends 108*m* selectively affixed to a corresponding weight module 118 (e.g., via the aforementioned notch-and-pocket arrangement shown in FIGS. 4*a*-4*b*). By doing so, the motive elastic member ends 108*m* are conveniently adjacently situated within easy reach of the user at the weight modules 118 as shown in FIGS. 1-2*d*, providing easier and more intuitive removal and replacement of user-selected elastic members 108.

Referring to FIG. 3, the frame 102 preferably includes a rest 124 situated between the anchor 104 and the carriage 106, whereby the rest 124 supports the weight modules 118 (and the carriage 106 thereon) when the carriage 106 is in the relaxed position of FIGS. 2*a*-2*b*. The rest 124 therefore maintains any weight modules 118 thereon in a position where the weight modules 118 can be readily affixed to the carriage 106 when the carriage 106 is in the relaxed position. Additionally, when the carriage 106 is moved toward its tensioned position (FIGS. 1 and 2*d*), the rest 124 supports any weight modules 118 that are detached from the carriage 106. Each weight module 118 and its rest 124 are preferably configured so that they complementarily interfit when the weight module 118 rests against the rest 124 (compare the bottom of the weight module 118 shown in FIG. 4*b* with the rest 124 of FIG. 3), maintaining the weight modules 118 in an orderly array along the rest 124 as seen in FIGS. 1-3.

The carriage 106 preferably bears a carriage actuating means allowing a user to move the carriage 106 in opposition to elastic resistance of the elastic members 108 without the need to grasp the carriage 106 itself. Such a carriage actuating means could simply take the form of a cable extending from the top of the carriage 106 to an aperture or pulley at the top of the frame 102, and then extending from the frame 102 to a suitable grip (e.g., a handle, bar, band, etc.) that may be moved by a user. However, as best seen in FIG. 3, a preferred arrangement is to provide one or more carriage pulleys 126 on the carriage 106, and have a cable 110 extend about each carriage pulley 126 such that each carriage pulley 126 has at least two segments of the cable 110 extend therefrom. The cable 110 can then extend from the frame 102 to a grip 128 (seen in FIGS. 1-2*d*). Since this arrangement's distance ratio—the ratio of input (cable 110) motion to output (carriage 106) motion—is equal to the number of the segments of cable 110 supporting the carriage 106, a large degree of cable motion is converted to a lesser degree of carriage motion, and thus to a lesser degree of elongation of the elastic members 108 affixed to the carriage 106. Owing to this lesser degree of stretch, the resistive forces exhibited by the attached member(s) 108 have less variation in their expressed resistive force, thereby better simulating the constant resistive force (weight) exhibited by a weight set.

The exercise device 100 can provide the light weight and lower cost of the aforementioned elastic resistance exercise devices with the ease, flexibility, and range of weight selection provided by the aforementioned weight-set exercise devices. A user may quickly and easily select and alter the amount of elastic resistance the user wishes to exercise with, and moreover may select a higher degree of elastic resistance than that offered by most prior exercise devices. As an example, the device 100 allows a user to select hundreds of pounds of resistance, which is particularly useful when the user wishes to perform certain types of leg exercises.

Further potential advantages, features, and objectives of the invention will be apparent from the remainder of this document in conjunction with the associated drawings.

BRIEF DESCRIPTION OF THE DRAWINGS

FIG. 4*a* is a perspective view of a weight module 118 of FIGS. 1-3, showing its motive end affixment member 114 (female socket) provided on a latch 116 pivotally affixed to the weight module 118, and showing notches 120 depressed into the weight module 118, with each notch 120 being bounded by a pocket 122 configured to receive the motive end 108*m* of an elastic member 108 (the motive end 108*m* being configured as the enlarged end of an elastic tube).

FIG. 4*b* is a perspective view of the weight module 118 of FIG. 4*a*, showing a groove 132 formed in the bottom of the weight module 118 whereby the groove 132 may receive the rest 124 (see FIG. 3) when the weight module 118 sits atop the rest 124.

FIGS. 5*a* and 5*b* are perspective views of an alternative anchor 504, wherein the fixed ends 508*f* of separate elastic members 508 are received in pockets 522 defined in the anchor 504 (these elastic members 508 having their motive ends 508*m* received in pockets 122 in a weight module 118 such as that of FIGS. 4*a*-4*b*).

DETAILED DESCRIPTION OF EXEMPLARY VERSIONS OF THE INVENTION

Figure 1:
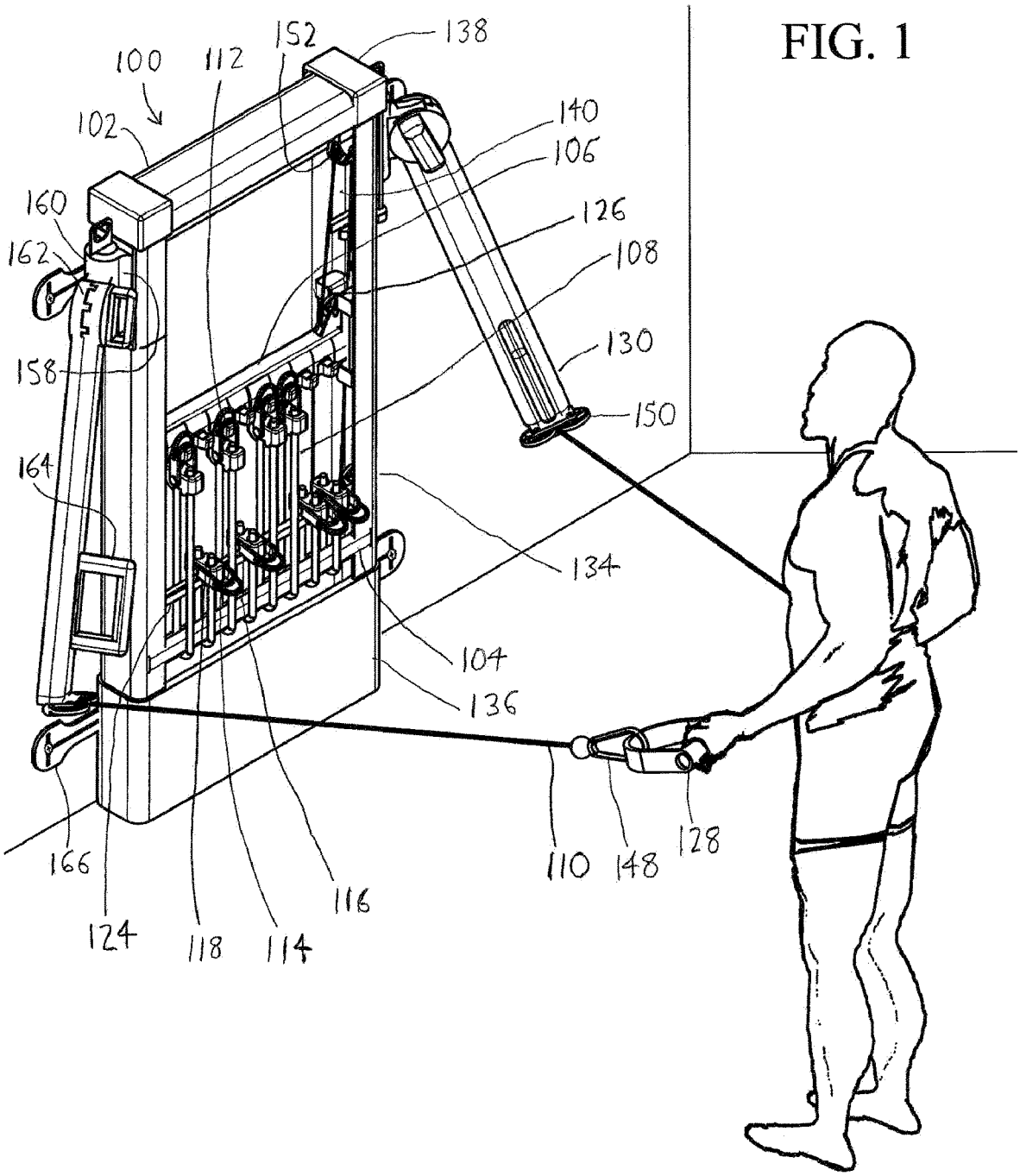
FIG. 1 is a perspective view of an exemplary exercise device 100 shown in use by a user, with its carriage 106 having selected elastic members 108 affixed thereto by latches 116 on the members' associated weight modules 118, and with the carriage 106 being moved from its relaxed position toward its tensioned position by the user's actuation of a cable 110 operatively linked to the carriage 106.

Expanding on the discussion above, with particular reference to FIG. 1, the exemplary exercise device 100 includes a frame 102 having opposing side columns 134 rising from a device base 136, with an upper header 138, an intermediate rest 124, and a lower anchor 104 extending between and being affixed to the columns 134. A carriage 106 moves between the rest 124 and the header 138 while being situated between the columns 134, the inner faces of which define channels 140 wherein the opposing sides of the carriage 106 ride (see FIG. 3). Elastic members 108 (here elastic tubes with enlarged ends) each extend upwardly from a fixed end 108*f* at the anchor 104 to a motive end 108*m* selectively attached the carriage 106, such that when a user actuates the carriage 106 to move it from a relaxed position adjacent the rest 124 (FIGS. 2*b*-2*c*) to a tensioned position spaced from the rest 124 and closer to the header 138 (FIGS. 1 and 2*d*), the user works against the elastic resistance of the elastic member(s) 108 attached to the carriage 106. The amount of work performed by the user depends on the number of elastic members 108 affixed to the carriage 106 and their elastic resistances, with the user being able to install different elastic members 108 having different resistances to change the overall weight (resistance) capacity of the exercise device 100. A user can therefore effectively obtain the same degree of weight variability as that provided by a conventional weight-set exercise device.

Figure 2A:
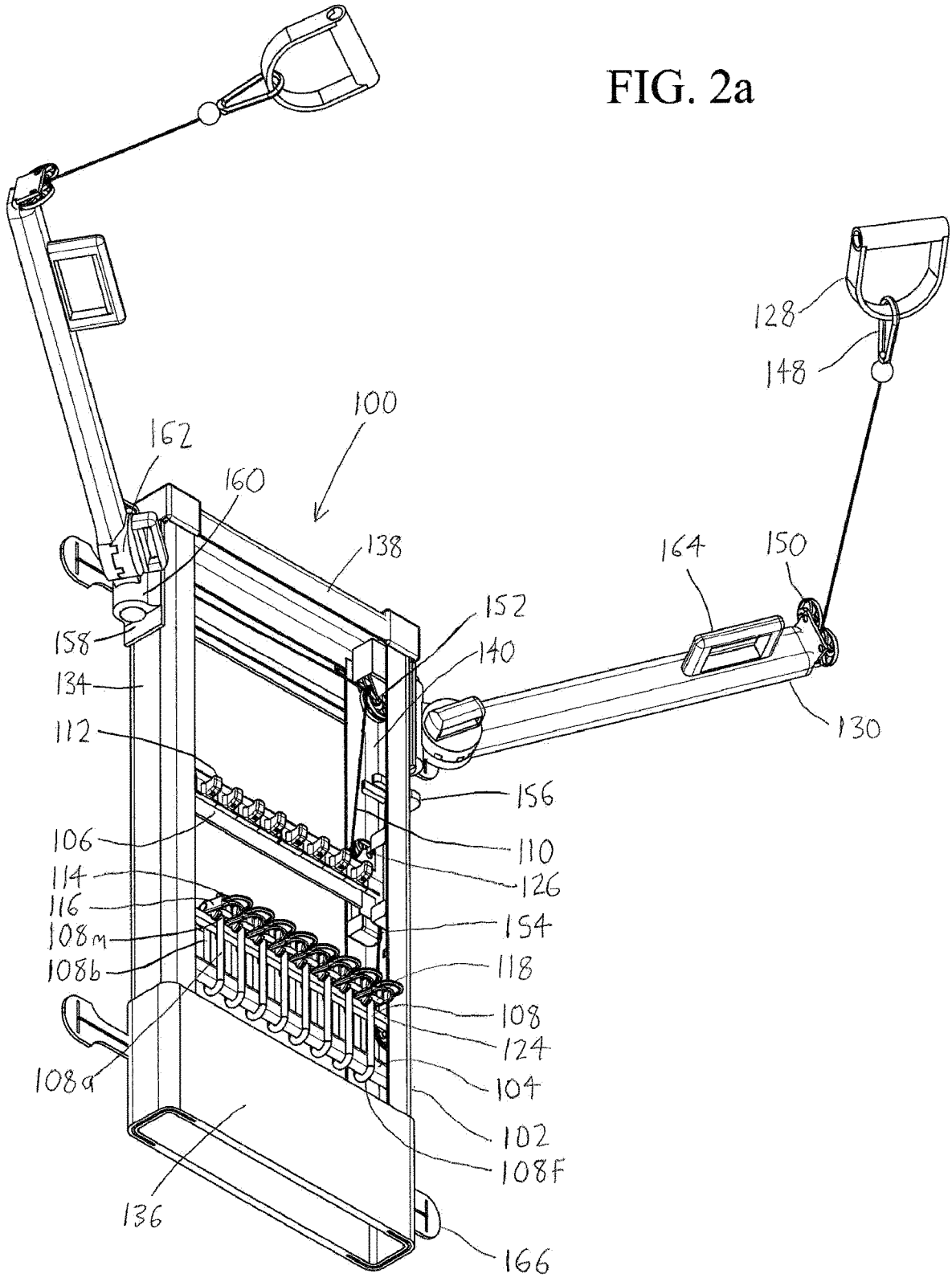
FIG. 2*a* is a perspective view of the exemplary exercise device 100 of FIG. 1 showing the weight modules 118 of the elastic members 108 unlatched from the carriage 106 (shown raised from its relaxed position for clarity), and showing the arms 130 of the exercise device 100 positioned differently from in FIG. 1.
Figure 2B:
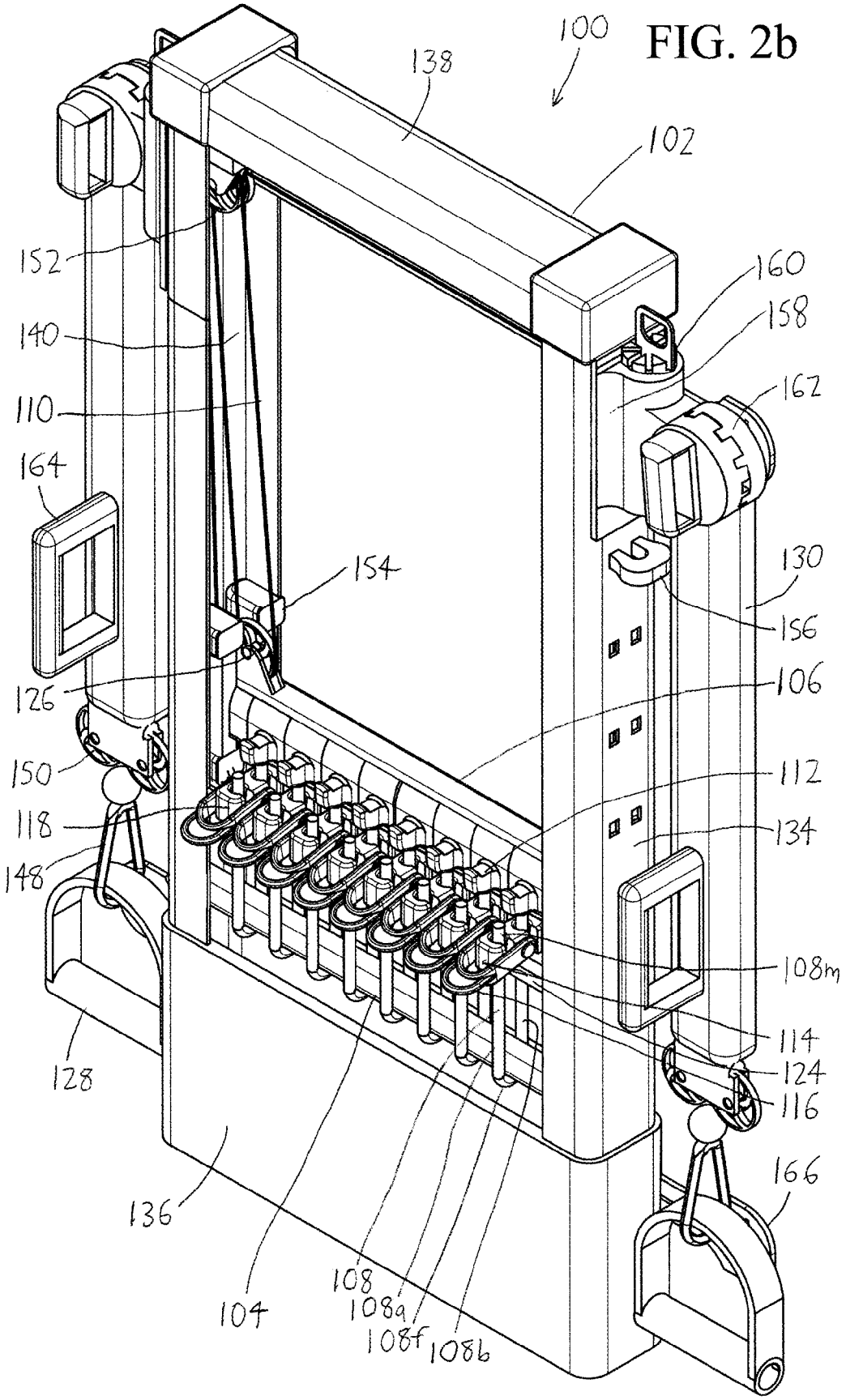
FIG. 2*b* is a perspective view of the exemplary exercise device 100 of FIGS. 1-2*a* showing the carriage 106 in its relaxed position such that it is ready for latching to the weight modules 118 of the elastic members 108, and showing the arms 130 of the exercise device 100 positioned differently from in FIGS. 1-2*a*.
Figure 2C:
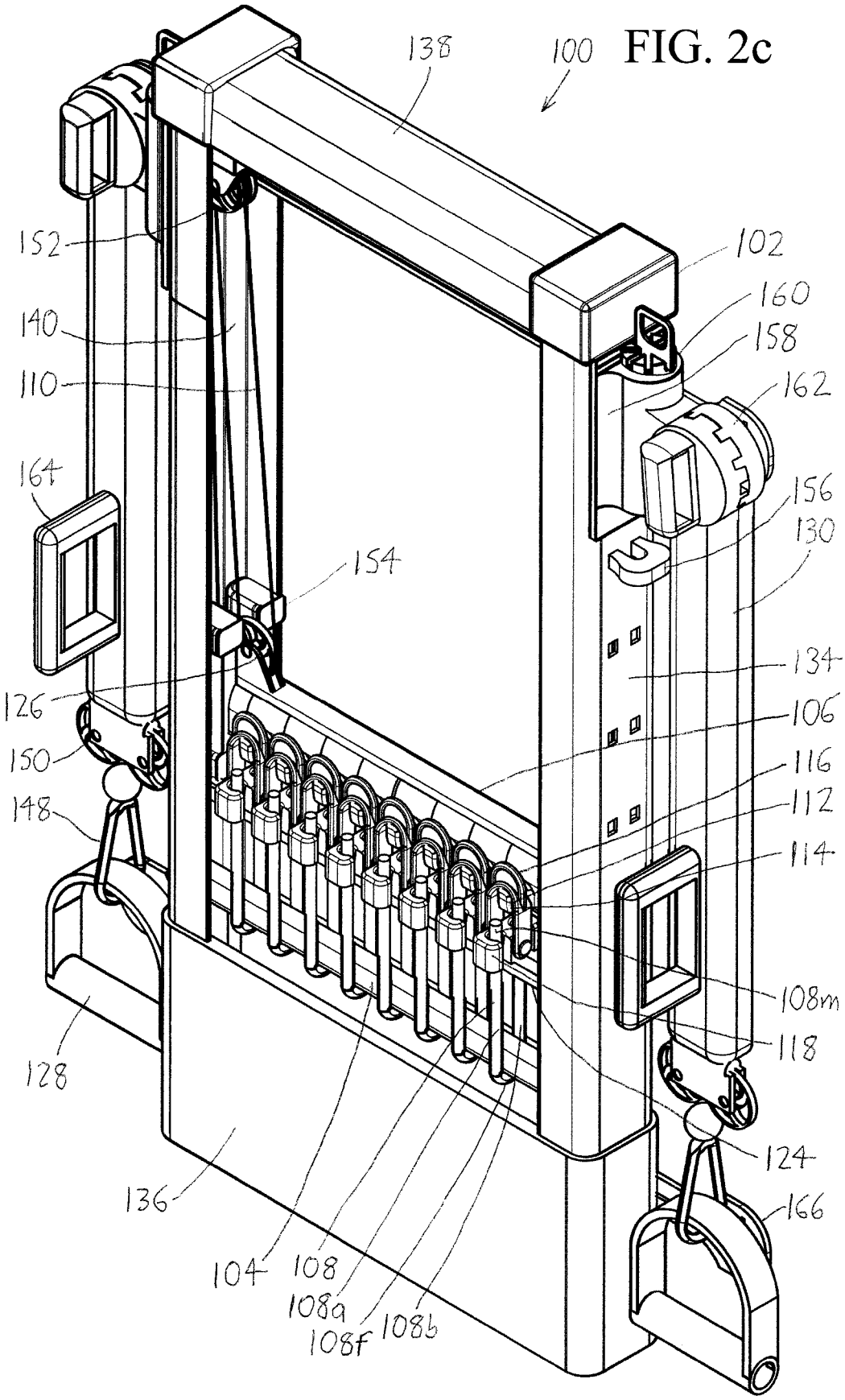
FIG. 2*c* is a perspective view of the exemplary exercise device 100 of FIG. 2*b* showing the elastic members 108 affixed to the carriage 106 via the latches 116 on the members' weight modules 118.
Figure 3:
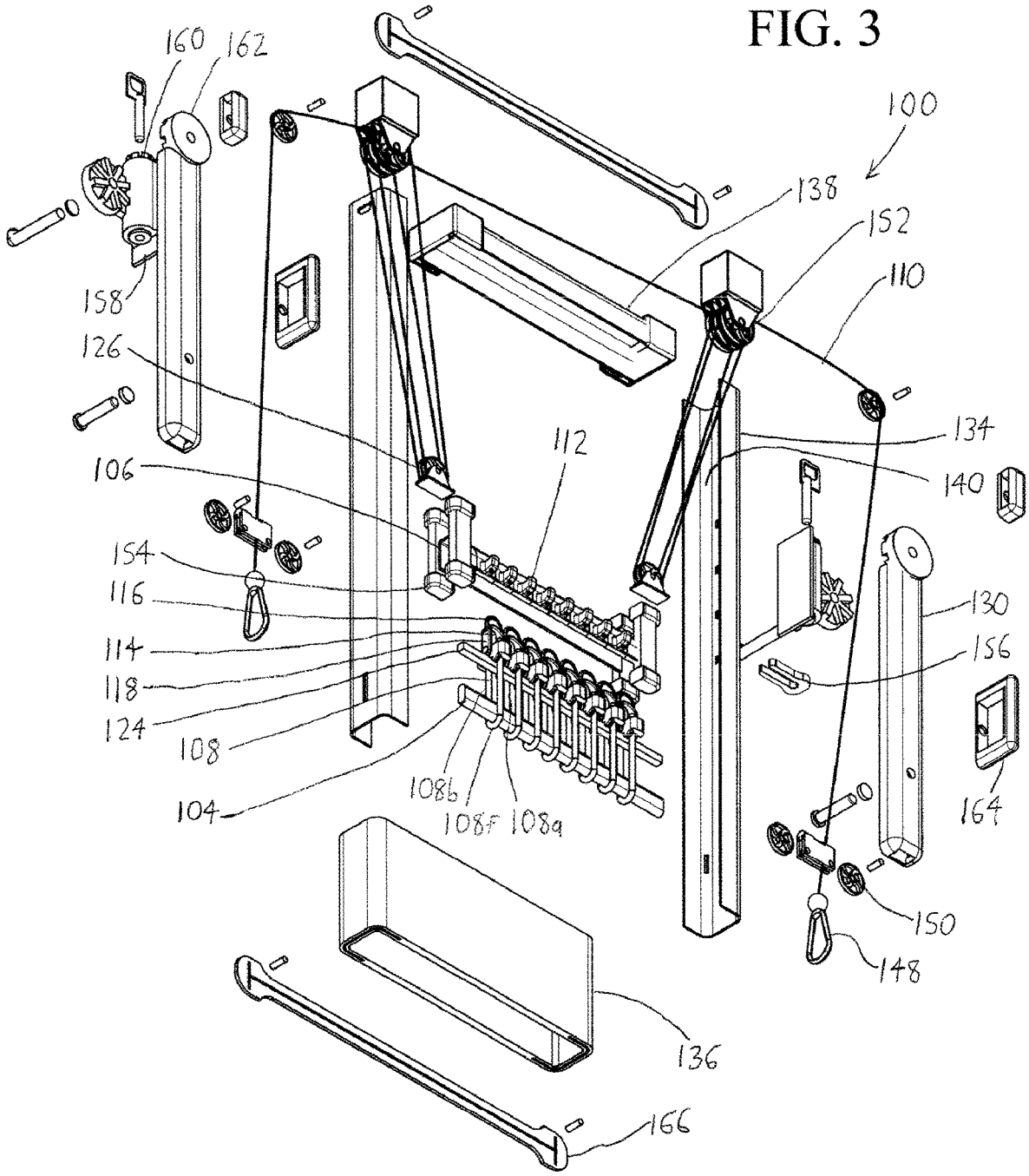
FIG. 3 is an exploded (disassembled) view of the exercise device 100 of FIGS. 1-2*d*, shown without the cable grips 128 used to actuate the carriage 106.

The motive ends 108*m* of the elastic members 108 are selectively affixed to the carriage 106 by motive end affixment members 114 in the form of female sockets defined in latches 116, with the motive end affixment members 114 being attachable and detachable to carriage affixment members 112 in the form of hook-like male members which protrude from the carriage 106 (best seen in FIG. 3). As seen by comparison of FIGS. 2*b* and 2*c*, user-selected elastic members 108 may be affixed to the carriage 106 by pivoting their latches 116 upwardly such that their female sockets 114 receive the male members 112 on the carriage 106 (and conversely, elastic members 108 may be detached from the carriage 106 by pivoting their latches 116 downwardly so that the male members 112 of the carriage 106 no longer rest 124 within the latches' female sockets 114). The latches 116 are provided on weight modules 118, shown in greater detail in FIGS. 4*a*-5*b*. These weight modules 118 preferably pivotally bear the latches 116 thereon, with the latches 116 having a clevis-like form wherein opposing legs of the latch 116 are pivotally pinned to opposing sides of the weight module 118. Blind (dead-ended) notches 120 are then defined in one or more sides of the weight module 118, with these notches 120 terminating in enlarged pockets 122. As seen in FIGS. 5*a*-5*b*, elastic members in the form of elastic tubes 508 having enlarged motive ends 508*m* can have portions of their lengths away from their enlarged motive ends 508*m* inserted into the notches 120 (with the tubes possibly being radially compressed to effect insertion), and can then be pulled along the axes of the pockets 122 until their enlarged motive ends 508*m* seat in the pockets 122. This action selectively affixes the motive ends 508*m* of the elastic members 508 to the weight modules 118, and thus to the carriage 106 when their weight modules 118 are selectively affixed to the carriage 106 as described above.

As seen in FIGS. 2*a*-2*c* and 3, the weight modules 118 each sit on the rest 124 when the weight modules 118 are in their relaxed positions (i.e., when their elastic members 108 have low or no tension). Looking to FIG. 4*b*, each weight module 118 preferably bears a bottom groove 132, here defined between opposing guides 142, with the groove 132 being configured to receive the rest 124 when the weight module 118 is in its relaxed position. The rest 124 therefore supports an array of weight modules 118 in positions situated for ready engagement to corresponding arrays of carriage affixment members 112 (see FIGS. 2*a*-2*c*). The bottom groove 132 on the weight module 118 also accepts the pin 144 of the pivoting latch 116, with the pin 144 then snap-fitting into an enlarged bearing passage 146 wherein the pin 144 may rotate to allow the latch 116 to pivot.

In the exemplary exercise device 100 of FIGS. 1-3, the elastic members 108 are selectively fixed to the anchor 104 by folding each elastic member 108 about the anchor 104 (see particularly FIG. 3) and affixing each of its opposing ends within the pockets 122 of a corresponding weight module 118 (see FIGS. 4*a*-4*b*). Thus, each elastic member 108 effectively has two motive ends 108*m* on the weight module 118, and a fixed end 108*f* at the anchor 104, with two elastic member segments 108*a* and 108*b* each extending from one of the motive ends 108*m* to the fixed end 108*f* (which is effectively affixed to the anchor 104 via the elastic tension of the elastic member 108). Each weight module 118 therefore effectively presents twice its elastic resistance to the carriage 106. This "folded" arrangement allows for compactness of the exercise device 100 of FIGS. 1-3, particularly where the exercise device 100 uses a pulley arrangement which reduces carriage travel, as discussed at greater length below.

However, alternative anchor arrangements are possible, with one being shown in FIGS. 5*a*-5*b*. Here the anchor 504 has a larger central passage 524 sized to receive the enlarged fixed end 108*f* of an elastic member 508, with the central passage 524 branching into notches 520 opening onto opposing pockets 522 into which the fixed ends 108*f* of two elastic members 508 may be removably affixed. Thus, the enlarged fixed end 508*f* can be inserted into the central passage 524, the elastic member 508 can be shifted through a notch 520 into one of the pockets 122, and the enlarged fixed end 508*f* will then be restrained to the anchor 504 when the elastic member 508 is tensioned. A second elastic member 508 can then be similarly installed in the opposite pocket 522. The anchor 504 therefore allows a pair of elastic members 508—which may exhibit different elastic resistances—to be affixed between the anchor 504 and a weight module 118, rather than using a single elastic member 108 which wraps about the anchor 104. Referring particularly to FIGS. 1 and 3, an array of such anchors 504 might be affixed to or formed within the device base 136, or even affixed to or formed within the anchor 104, to accommodate elastic members 108 extending from the pockets 122 of the weight modules 118. The anchor 504 allows for even greater versatility in selecting the weight/elastic resistance to be exhibited by a weight module 118, as a user may affix only a single elastic member, or two elastic members having the same or different resistance, between the anchor 104 and the weight module 118.

As seen in FIG. 1, a user moves the carriage 106 to act against the resistances of the elastic cables 110 affixed thereto by acting on grips 128 at opposing ends of a cable 110 operatively linked to the carriage 106. Looking to the left side of FIGS. 1 and 3, the cable 110 extends:

(a) from a grip attachment 148 (here a carabiner, allowing the attachment of different types of grips) through rollers 150 situated within the lower end of a repositionable arm 130 (discussed below);

(b) through the interior of the arm 130 to its upper end, where a roller redirects the cable 110 into an aperture in the left column 134 and atop a three-groove header pulley 152, with the cable 110 being received in the first groove of the header pulley 152;

(c) downwardly from the header pulley 152 to wrap beneath a two-groove carriage pulley 126, with the cable 110 being received in the first groove of the carriage pulley 126;

(d) upwardly from the carriage pulley 126 to wrap above the header pulley 152 within its second header pulley groove, (e) downwardly from the header pulley 152 to wrap beneath the carriage pulley 126 within its second carriage pulley groove;

(f) upwardly from the carriage pulley 126 to wrap above the header pulley 152 within its third header pulley groove, and (g) then toward a header pulley 152 atop the right column 134 and a carriage pulley 126 at the right side of the carriage 106, with the pulley/cable 110 arrangement at the right side of the exercise device being symmetric to the left side arrangement of (a)-(f) above.

As the carriage 106 is supported by four cable segments per grip 128, this pulley arrangement results in a distance ratio (the ratio of input grip motion to output carriage motion) of 4:1, i.e., the carriage travel distance is one-fourth the collective distance traveled by the grips 128 (or one-eighth the distance traveled by a single grip 128 if only one grip 128 is moved). Thus, as an example, simultaneous extension of each of the ends of the cable 110 by 24 inches, or extension of one of the ends of the cable 110 by 48 inches, will only move the carriage 106 (and stretch the elastic members 108) by 6 inches. This reduction in the travel of the carriage 106 beneficially allows the exercise device to take a more compact form. Additionally, since the user's input grip motion is converted to lower carriage travel distance, the elastic members 108—whose elastic resistance increases roughly linearly with their elongation—present less variability in the resistive force felt by the user, as elongation is limited to a lower range. This decreased variability therefore presents a "feel" which is more consistent with that presented by a conventional weight-set exercise device 100.

Further features of the exemplary exercise device 100 are best reviewed with reference to FIGS. 1 and 3. Runners 154 are situated at opposing ends of the carriage 106, and are configured to ride within the channels 140 defined in the inner sides of the columns 134. While not depicted, these runners 154 may bear rollers or other structures which promote the runners' translation along their columns 134 with low or no friction/resistance. The carriage pulleys 126 are affixed to the ends of the carriage 106 between the runners 154. A carriage lock may be provided to lock the carriage 106 in place at a desired location along the columns 134, with the carriage lock here being provided as a key 156 which is insertable through a column 134 and into the end of the carriage 106. This arrangement secures the cables 110 leading from the grips 128, and allows a user to use the grips 128 for suspension training exercises, also referred to as bodyweight exercises (see US Patent Appl'n. Publ'n. 20130217547A1). While not depicted, the key 156 could be spring-loaded to engage the carriage 106 unless urged by a user into a released position. Alternatively, the key 156 may be situated on the carriage 106, and could be spring-loaded to engage a column 134.

The repositionable arms 130 are an optional feature and need not be included on the exercise device 100, though they are useful to allow a user to reposition the location where the cables 110 and grips 128 extend from the exercise device 100 (thereby redirecting the force vectors against which a user works during exercise). Each repositionable arm 130 is mounted near the top of a column 134 via an arm base 158 bearing a horizontal joint 160 (having a vertically-oriented pivot axis), with the horizontal joint 160 then bearing a vertical joint 162 (having a horizontally-oriented pivot axis), with both joints 160 and 162 being lockable to restrain the arms 130 at desired locations. The arms 130 additionally bear arm grips 164, which can be used for pull-ups or other suspension training exercises.

Brackets 166 are provided for attachment of the exercise device 100 to a wall, preferably at its device base 136 and header 138. The exercise device 100 need not be wall-mounted, and could be mounted to other surfaces. Alternatively, the exercise device 100 need not be mounted to a surface at all, as by forming it with a ballast (e.g., a weighted base 136) to prevent it from moving when a user acts on it, or by restraining it with a user's body weight (such as by providing it on a platform on which a user stands, or within a bench on which the user sits or lays).

To use the exercise device 100, a user selects elastic members 108 having desired elastic resistances, and installs them on weight modules 118 atop the rest 124. Each weight module 118 can be installed by (for example) inserting one end of a desired elastic member 108 into one pocket 122 of a weight module 118 (see FIG. 4*a*), then placing the weight module 118 atop the rest 124 such that the elastic member 108 dangles behind the rest 124 and anchor 104, grasping the lower end of the elastic member 108 and pulling it forwardly of the anchor 104, and then upwardly to the weight module 118 to install this end into the other pocket 122 of the weight module 118. Provided the bottom groove 132 (FIG. 4*b*) in a weight module 118 suitably receives the rest 124, a user need not also hold the weight module 118 in place during installation of the elastic member 108.

Ideally, the elastic members 108 are installed with some degree of tension (e.g., with 20% of their maximum elongation), as elastic members 108 tend to deviate from a linear force vs. stretch relationship as they begin stretching, and additionally as they approach their maximum elongation. Thus, pre-tensioning the elastic members 108 better ensures that their subsequent elongation is within the linear range, resulting in a "feel" to a user that more naturally simulates the use of a weight-set exercise device.

Figure 2D:
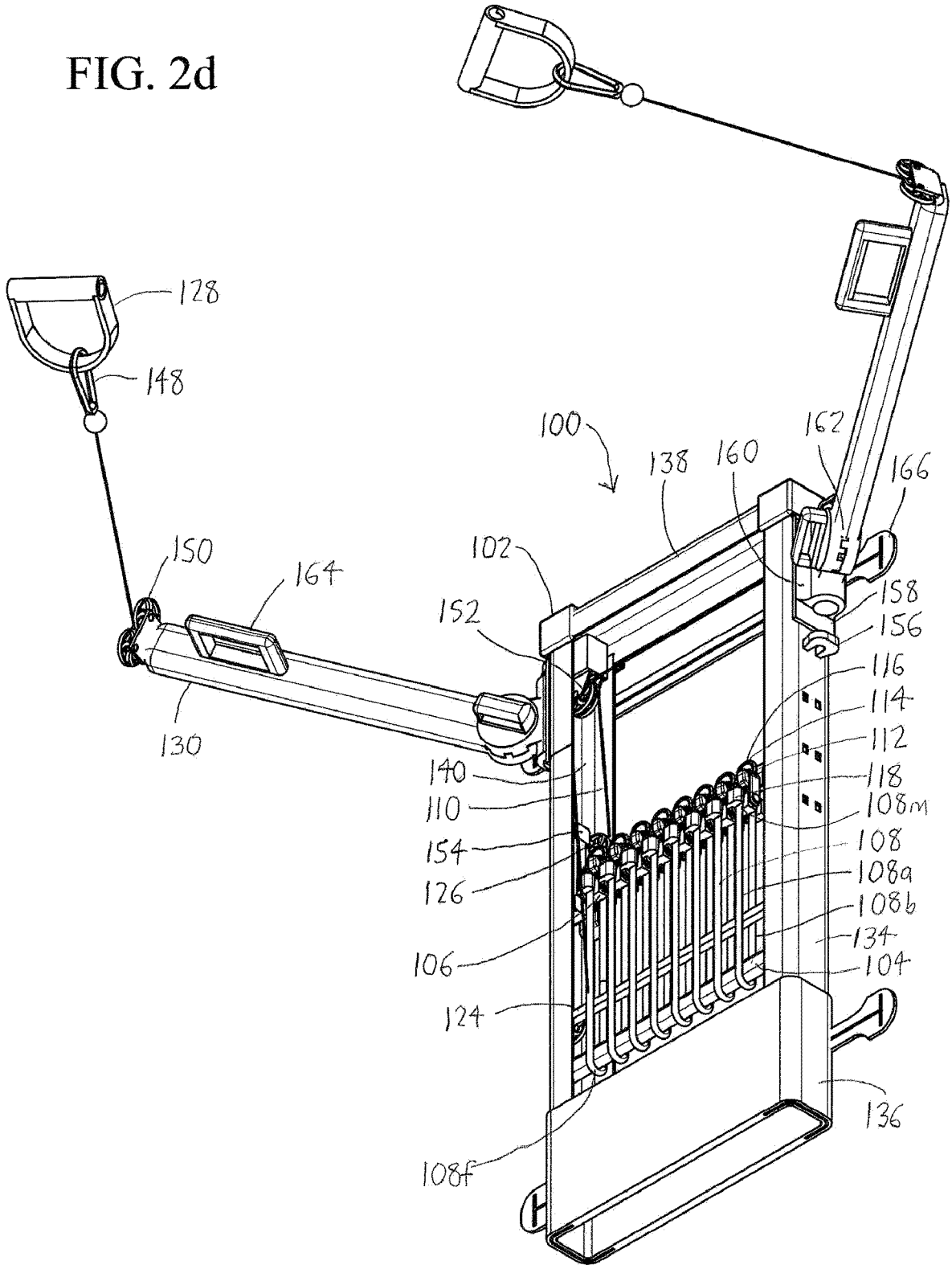
FIG. 2*d* is a perspective view of the exemplary exercise device 100 of FIGS. 1-2*c* showing the carriage 106 in its tensioned position with the attached elastic members 108 stretched, and shown with the arms 130 of the exercise device 100 positioned as in FIG. 2*a*.

Once all weight modules 118 are installed, the user can select one or more elastic members 108 for use by moving their latches 116 as shown in FIGS. 2*b*-2*c*, such that their motive end affixment members (female sockets) 114 are engaged by the corresponding carriage affixment members (male prongs) 112 on the carriage 106. The user may then grasp one or more of the grips (FIG. 1) and actuate the carriage 106 to work against the elastic resistances of the selected elastic members 108.

As the exercise device 100 of FIGS. 1-3 is merely exemplary, it should be understood that its configuration and features may be modified in numerous respects. A non-exhaustive list of potential modifications follows.

While the exemplary exercise device 100 uses elastic members 108 formed as hollow elastic tubes having enlarged (stoppered/plugged) ends, other elastic members could be used instead (e.g., solid cables, straps, bars, etc.), including multicomponent elastic members (e.g., woven multi-strand cables, side-by-side straps, etc.). Moreover, elastic members need not be formed of elastomeric materials, and could be formed of metal or other materials (e.g., in the form of helical or other springs).

As discussed, the fixed and motive ends 108*f* and 108*m* of the elastic members 108 are preferably selectively affixable to the anchor 104 and to the weight modules 118 (or directly to the carriage 106) via notches 120 extending into pockets 122, wherein the lengths of elastic members 108 can be inserted into the notches 120, and the pockets 122 are sized to prohibit the passage of the enlarged ends of the elastic members 108. Other forms of affixment could be used, such as male members on the anchor 104, the weight modules 118, and/or the carriage 106 engaging female apertures defined at the fixed and/or motive ends 108*f* and 108*m* of the elastic members 108. Conversely, female sockets on the anchor 104, the weight modules 118, and/or the carriage 106 could engage male members defined at the fixed and/or motive ends 108*f* and 108*m* of the elastic members 108. Alternatively, some or all elastic members 108 could be permanently affixed to the anchor 104, the weight modules 118, and/or the carriage 106.

The configurations of the motive end affixment members 114 and the carriage affixment members 112 may be reversed; for example, a motive end affixment member could take the form of a male member, and a carriage affixment member could take the form of a female socket configured to receive the male member. Thus, for example, the motive end affixment member might take the form of a hook on an elastic member 108 (e.g., on a weight module 118 affixed to the elastic member 108), with the carriage affixment member taking the form of a female socket on the carriage 106 (e.g., on a latch on the carriage 106 which is pivotable to receive the hook in a female socket defined within the latch). The male/female configurations of the motive end affixment members and the carriage affixment members could differ from the depicted pin-and-socket arrangement, and could (for example) involve a threaded male member and complementarily threaded female socket, a hooked male member and a receiving female socket, or other male/female interconnects. One or more of the male member and female socket might be spring-loaded toward engagement with the other, e.g., the latch 116 could be spring-loaded such that its female socket 114 remains engaged with a corresponding male member 112 until urged into disengagement by a user. Conversely, a male prong on a latch 116 on one of the weight module 118 and carriage 106 might be spring-loaded to fit within a female socket in the other of the weight module 118 and the carriage 106 until urged into disengagement by a user.

The motive end affixment member 114 (whether a female socket or male member) need not be provided on a pivoting latch 116 on a weight module 118, and could instead be immovably situated on the weight module 118. For example, consider the weight module 118 of FIGS. 4*a* and 5*a*-5*b* wherein the latch 116 is integrally and immovably formed with the weight module 118, in which case a user could simply manipulate the weight module 118 such that its socket 114 receives (or expels) a male prong/hook 112 on the carriage 106.

The invention need not operate with the elastic members 108, direction of carriage 106 travel, and direction of cable 110 travel shown and described above; for example, the elastic members 108 might elongate (and the carriage 106 might travel) horizontally, rather than vertically, or along a bent or curved path (with elastic members 108 bending about rollers/pulleys or the like).

The number of weight modules 118, elastic members 108, anchors 104, pulleys 126 and/or 152, etc. may each vary independently. For example, more or fewer weight modules 118 might be used, and each may accommodate one or more elastic members 108. Each anchor 104 could accommodate one or more elastic members, with each weight module 118 being configured to accommodate the same number of elastic members 108 or fewer. The carriage 106 need not be actuated by cables 110; for example, it could be actuated by a user via a bar or handles protruding from the carriage 106.

As described above, the exercise device 100 preferably configures the weight modules 118 and the rest 124 such that they complementarily interfit when the weight modules 118 engage the rest 124 (e.g., via the groove 132 of FIG. 4*b* receiving the rest 124 therein). Features for situating the weight modules 118 on the rest 124 can be provided on either or both of the modules 118 and the rest 124; for example, while the guides 142 and groove 132 help situate the weight module 118 on the rest in directions perpendicular to the length of the rest, the rest 124 might bear channels/indentations into which the weight modules 118 fit to assist with properly arraying the modules 118 across the length of the rest. Other arrangements for situating the weight modules 118 on the rest 124 are also possible, e.g., male members protruding from the rest 124 (preferably tapering to larger widths at their bases on the rest 124) could be complementarily received within sockets on the modules 118.

The configuration and components of the exercise device 100 can vary significantly from those shown in FIGS. 1-3. As one example, the columns 134 could be formed as posts or rails, with the columns 134 being situated within apertures at the opposing sides of the carriage 106. The carriage 106 could then be actuated to ride along the columns 134 via cables 110 extending from pulleys 152 situated at or near the top of the columns 134. As another example, the carriage 106 could have a squat cylindrical (drum-like) or cuboid (box-like) form, and could ride along a single concentrically-situated column 134 (e.g., a cylindrical post) rising upwardly from a weighted base 136, with the carriage 106 being actuated to ride along the column 134 via a cable 110 extending from a pulley 152 situated at or near the top of the column 134. The elastic members 108 could then be spaced about the (circular or square) perimeter of the carriage 106 to extend to a (circular or square) anchor 104. In this example, a user might use two such exercise devices, one for each arm (or leg), with the exercise devices being repositionable such that the user can place them as desired.

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims. In these claims, no element therein should be interpreted as a "means-plus-function" element or a "step-plus-function" element pursuant to 35 U.S.C. § 112(f) unless the words "means for" or "step for" are explicitly used in the particular element in question.

What is claimed is:

1. An exercise device including:

a. a carriage:
  (1) configured to move along a frame between a relaxed position and a tensioned position,
  (2) having carriage affixment members thereon, b. two or more elongated elastic members, each elastic member having:
  (1) a fixed elastic member end fixed with respect to the frame, and
  (2) a motive elastic member end, each motive elastic member end:
    (a) having a motive end affixment member thereon, each motive end affixment member being configured for selective fixation to one of the carriage affixment members,
    (b) being selectively affixable to the motive end affixment member thereon, whereby the carriage is movable by a user in opposition to elastic resistance of the elastic members.

2. The exercise device of claim 1 wherein:

a. each motive end affixment member is one of:
  (1) a male member, and
  (2) a female socket configured to receive the male member, b. each carriage affixment member is the other of the male member and the female member.

3. The exercise device of claim 1 wherein:

a. each motive end affixment member is pivotally repositionable with respect to the motive elastic member end whereupon the motive end affixment member is provided, or b. each carriage affixment member is pivotally repositionable with respect to the carriage.

4. An exercise device including:

a. carriage:
  (1) configured to move along a frame between a relaxed position and a tensioned position,
  (2) having carriage affixment members thereon, b. two or more elongated elastic members, each elastic member having:
  (1) a fixed elastic member end fixed with respect to the frame, and
  (2) a motive elastic member end, each motive elastic member end having a motive end affixment member thereon, each motive end affixment member being configured for selective fixation to one of the carriage affixment members, whereby the carriage is movable by a user in opposition to elastic resistance of the elastic members, c. a weight module having a pocket defined therein, the pocket being configured to:
  (1) accept insertion of one of the elastic members in a first direction, and thereafter
  (2) resist withdrawal of the elastic member from the pocket in a second direction oriented along an axis different from the axis of the first direction, d. a pivotable latch:
  (1) provided on one of:
    (a) the weight module, and
    (b) the carriage,
  (2) configured to pivot toward and engage the other of the weight module and the carriage.

5. The exercise device of claim 4:

a. wherein the latch has a female socket therein, b. further including a male member provided on the other of the weight module and the carriage, whereby the latch receives the male member within the female socket when pivoted toward the other of the weight module and the carriage.

6. An exercise device including:

a. a carriage:
  (1) configured to move along a frame between a relaxed position and a tensioned position,
  (2) having carriage affixment members thereon, b. two or more elongated elastic members, each elastic member having:
  (1) a fixed elastic member end fixed with respect to the frame, and
  (2) a motive elastic member end, each motive elastic member end having a motive end affixment member thereon, each motive end affixment member being configured for selective fixation to one of the carriage affixment members, whereby the carriage is movable by a user in opposition to elastic resistance of the elastic members, c. weight modules, each weight module:
  (1) having one of the motive end affixment members provided thereon, and
  (2) being selectively affixable to one of the motive elastic member ends.

7. The exercise device of claim 6, wherein each motive end affixment member is pivotally affixed to one of the weight modules.

8. The exercise device of claim 6 wherein:

a. each elastic member extends about an anchor affixed to the frame, with each elastic member thereby having:
  (1) the elastic member's fixed elastic member end at the anchor, and
  (2) two motive elastic member ends,
  (3) two elastic member segments, each elastic member segment extending from the fixed elastic member end to one of the motive elastic member ends, b. each weight module:
  (1) is selectively affixable to the two motive elastic member ends of one of the elastic members, and
  (2) has opposing weight module sides, each weight module side having one of the motive end affixment members thereon.

9. The exercise device of claim 8 further including a rest:

a. affixed to the frame, b. spaced from the anchor, and c. against which the weight modules rest when the carriage is in the relaxed position.

10. An exercise device including:

a. a carriage:

(1) configured to move along a frame between a relaxed position and a tensioned position, (2) having carriage affixment members thereon, b. two or more elongated elastic members, each elastic member having:

(1) a fixed elastic member end fixed with respect to the frame, and (2) motive elastic member end, each motive elastic member end having a motive end affixment member thereon, each motive end affixment member being configured for selective fixation to one of the carriage affixment members, whereby the carriage is movable by a user in opposition to elastic resistance of the elastic members, c. an anchor affixed to the frame, wherein each elastic member extends about the anchor, whereby two elastic member segments of the elastic member extend from the anchor to define:

(a) the fixed elastic member end of the elastic member at the anchor, and (b) two motive elastic member ends of the elastic member, each motive elastic member end being situated on one of the two elastic member segments of the elastic member.

11. The exercise device of claim 10 further including a rest:

a. affixed to the frame, b. situated between the anchor and the carriage, and c. supporting the carriage when the carriage is in the relaxed position.

12. The exercise device of claim 11 further including weight modules, each weight module:

a. having one of the motive end affixment members provided thereon, and b. being selectively affixable to one of the motive elastic member ends, wherein each weight module is configured to complementarily interfit with the rest when resting thereagainst.

13. An exercise device including:

a. a carriage:

(1) configured to move along a frame between a relaxed position and a tensioned position, (2) having carriage affixment members thereon, (3) a pulley thereon, b. two or more elongated elastic members, each elastic member having:

(1) a fixed elastic member end fixed with respect to the frame, and (2) a motive elastic member end, each motive elastic member end having a motive end affixment member thereon, each motive end affixment member being configured for selective fixation to one of the carriage affixment members, whereby the carriage is movable by a user in opposition to elastic resistance of the elastic members, c. a cable extending:

(1) about the pulley, whereby at least two segments of the cable extend from the pulley, and (2) from the frame, whereby the carriage is movable by a user in opposition to elastic resistance of the elastic members by pulling on the cable.

14. An exercise device including:

a. a frame, b. an anchor situated on the frame, c. a carriage configured to translate along the frame between:

(1) a relaxed position, and (2) a tensioned position further from the anchor than the relaxed position, d. weight modules, each weight module being configured to selectively affix to the carriage, e. elongated elastic members, each elastic member having:

(1) a fixed elastic member end on the anchor, and (2) a motive elastic member end, each motive elastic member end being configured to selectively affix to one of the weight modules.

15. The exercise device of claim 14 further including a rest:

a. affixed to the frame, b. situated between the anchor and the carriage, and c. against which the weight modules rest when the carriage is in the relaxed position.

16. The exercise device of claim 14 wherein:

a. the carriage bears a row of carriage affixment members, b. each weight module bears at least one motive end affixment member, each motive end affixment member being configured for selective fixation to one of the carriage affixment members.

17. The exercise device of claim 16 wherein:

a. each carriage affixment member includes one of a male member or a female socket, b. each motive end affixment member includes the other of the male member and the female socket, c. each female socket is configured to receive one of the male members therein.

18. The exercise device of claim 14 wherein each elastic member:

a. extends about the anchor, and b. has two of the motive elastic member end, with the fixed elastic member end being situated between the motive elastic member ends.

19. An exercise device including:

a. a frame, b. an anchor situated on the frame, c. a carriage configured to move along the frame between:

(1) a relaxed position, and (2) a tensioned position further from the anchor than the relaxed position, d. elongated elastic members, each elastic member having:

(1) a fixed elastic member end fixed with respect to the anchor, and (2) a motive elastic member end, e. weight modules, each weight module being configured to:

(1) selectively affix to one or more motive elastic member ends, and (2) selectively affix to the carriage.

20. The exercise device of claim 6 wherein each motive elastic member end is selectively affixable to the motive end affixment member thereon.

* * * * *